US010867570B2

(12) United States Patent
Lee et al.

(10) Patent No.: US 10,867,570 B2
(45) Date of Patent: Dec. 15, 2020

(54) DISPLAY DEVICE AUTOMATICALLY SETTING GATE SHIFT AMOUNT AND METHOD OF OPERATING THE DISPLAY DEVICE

(71) Applicant: SAMSUNG DISPLAY CO., LTD., Yongin-si (KR)

(72) Inventors: Jae-Han Lee, Hwaseong-si (KR); Sun-Koo Kang, Seoul (KR); Soo Yeon Kim, Namyangju-si (KR); Tae Gon Im, Gwangmyeong-si (KR); Moon Shik Kang, Hwaseong-si (KR); Jung Hwan Cho, Asan-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/397,263

(22) Filed: Apr. 29, 2019

(65) Prior Publication Data

US 2019/0340989 A1 Nov. 7, 2019

(30) Foreign Application Priority Data

May 2, 2018 (KR) ..... 10-2018-0050909

(51) Int. Cl.
*G09G 3/36* (2006.01)
*G09G 3/00* (2006.01)

(52) U.S. Cl.
CPC ..... *G09G 3/3677* (2013.01); *G09G 3/006* (2013.01); *G09G 3/3688* (2013.01);
(Continued)

(58) Field of Classification Search
CPC ..... G09G 3/006; G09G 3/20; G09G 3/2092; G09G 3/2096; G09G 3/3266–3291;
(Continued)

(56) References Cited

U.S. PATENT DOCUMENTS

2002/0000961 A1* 1/2002 Kang ..... G02F 1/13452 345/87
2006/0139263 A1* 6/2006 Choi ..... G09G 3/3283 345/76

(Continued)

FOREIGN PATENT DOCUMENTS

KR 10-0329465 3/2002
KR 10-2015-0079273 7/2015

(Continued)

*Primary Examiner* — Nathan Danielsen
(74) *Attorney, Agent, or Firm* — F. Chau & Associates, LLC

(57) ABSTRACT

A display device includes a display panel including data lines, gate lines, and pixels connected to the data lines and the gate lines, a data driver configured to drive the data lines, a plurality of gate drivers, each configured to drive a corresponding portion of the gate lines, and a plurality of feedback lines connected to one of the data lines at a plurality of measurement positions corresponding to the plurality of gate drivers. The data driver applies a test voltage to the data line, receives the test voltage as a plurality of feedback voltages through the plurality of feedback lines, and determines gate shift amounts at the plurality of measurement positions corresponding to the plurality of gate drivers based on the plurality of feedback voltages. The gate drivers apply gate signals to the gate lines that are shifted by the determined gate shift amounts.

20 Claims, 12 Drawing Sheets

(52) U.S. Cl.
CPC . *G09G 2310/0251* (2013.01); *G09G 2310/08* (2013.01); *G09G 2320/0223* (2013.01)

(58) Field of Classification Search
CPC ..... G09G 3/3674–3688; G09G 2310/0248; G09G 2310/0251; G09G 2310/0264–0272; G09G 2310/067; G09G 2310/08; G09G 2320/0219; G09G 2320/0223; G09G 2320/0233; G09G 2320/0242–0252
See application file for complete search history.

(56) References Cited

U.S. PATENT DOCUMENTS

| | | | | |
|---|---|---|---|---|
| 2007/0052656 | A1* | 3/2007 | Park ..... | G09G 3/3677 345/100 |
| 2007/0085798 | A1* | 4/2007 | Hashimoto ..... | G09G 3/3677 345/93 |
| 2015/0294614 | A1* | 10/2015 | Duan ..... | G09G 3/2092 345/214 |

FOREIGN PATENT DOCUMENTS

| | | |
|---|---|---|
| KR | 10-2016-0048273 | 5/2016 |
| KR | 10-2016-0083587 | 7/2016 |
| KR | 10-2016-0084928 | 7/2016 |
| KR | 10-2016-0110859 | 9/2016 |

* cited by examiner

DISPLAY DEVICE AUTOMATICALLY SETTING GATE SHIFT AMOUNT AND METHOD OF OPERATING THE DISPLAY DEVICE

CROSS-REFERENCE TO RELATED APPLICATION(S)

This application claims priority under 35 USC § 119 to Korean Patent Applications No. 10-2018-0050909, filed on May 2, 2018 in the Korean Intellectual Property Office (KIPO), the disclosure of which is incorporated by reference in its entirety herein.

BACKGROUND

1. Technical Field

Exemplary embodiments of the inventive concept relate generally to display devices, and more particularly to display devices that automatically set gate shift amounts and methods of operating the display devices.

2. Discussion of Related Art

A display device typically includes a plurality of pixels and a data driver that provides data voltages to the pixels to display an image corresponding to the data voltages. A data voltage applied to one of the pixels may be delayed by a resistor-capacitor (RC) delay according to the distance between the data driver and the one pixel. The data voltage applied to a given pixel needs to have a desired voltage level in order for an observer to perceive that the given pixel has the intended appearance. The amount of time it takes for the data voltage to transition from an initial voltage level or previous voltage level to the desired voltage level may be referred to as a transition time. A transition time of the data voltage for a pixel that is relatively far from the data driver is greater than a transition time of the data voltage for a pixel that is relatively close to the data driver. Accordingly, as the distance from the data driver increases, the transition time of the data voltage increases, and thus a charging rate of the pixel decreases, which results in deterioration of image quality. In particular, as a resolution of the display device increases, 1 horizontal time (1H) decreases, and thus the deterioration of image quality may be intensified.

SUMMARY

At least one exemplary embodiment of the inventive concept provides a display device which automatically sets a gate shift amount to provide a substantially uniform charging rate.

At least one exemplary embodiment of the inventive concept provides a method of operating a display device which automatically sets a gate shift amount to provide a substantially uniform charging rate.

According to an exemplary embodiment of the inventive concept, there is provided a display device including a display panel including data lines, gate lines, and pixels connected to the data lines and the gate lines, at least one data driver configured to drive the data lines, a plurality of gate drivers, each of the plurality of gate drivers configured to drive a corresponding portion of the gate lines, and a plurality of feedback lines connected to at least one of the data lines at a plurality of measurement positions corresponding to the plurality of gate drivers. The data driver applies a test voltage to the at least one of the data lines, receives the test voltage as a plurality of feedback voltages through the plurality of feedback lines, and determines gate shift amounts at the plurality of measurement positions corresponding to the plurality of gate drivers based on the plurality of feedback voltages. The gate drivers apply gate signals to the gate lines that are shifted by the determined gate shift amounts.

In an exemplary embodiment, the plurality of feedback lines include a plurality of last gate feedback lines. Each of the plurality of last gate feedback lines is connected to the at least one of the data lines at the measurement position corresponding to a last gate line among the corresponding portion of the gate lines driven by a corresponding one of the plurality of gate drivers.

In an exemplary embodiment, the plurality of feedback lines further include a start gate feedback line connected to the at least one of the data lines at the measurement position corresponding to one of the gate lines closest to the data driver.

In an embodiment, the data driver measures delay amounts of the plurality of feedback voltages received through the plurality of last gate feedback lines with respect to the feedback voltage received through the start gate feedback line, and determines the gate shift amounts at the plurality of measurement positions as the delay amounts of the plurality of feedback voltages.

In an embodiment, the data driver includes a plurality of comparators configured to compare the plurality of feedback voltages received through the plurality of last gate feedback lines and the start gate feedback line with a reference voltage, a plurality of XOR gates, each of the plurality of XOR gates configured to perform an XOR operation on two adjacent output signals among a plurality of output signals output by the plurality of comparators, and a plurality of counters configured to count high periods of a plurality of output signals output by the plurality of XOR gates.

In an exemplary embodiment, the plurality of feedback lines further include a plurality of middle gate feedback lines, each of the plurality of middle gate feedback lines connected to the at least one of the data lines at the measurement position corresponding to a middle gate line among the corresponding portion of the gate lines driven by the corresponding one of the plurality of gate drivers.

In an embodiment, the plurality of gate drivers are mounted on a plurality of flexible films attached to the display panel, and a portion of each of the plurality of feedback lines is located on the plurality of flexible films.

In an embodiment, the portion of each of the plurality of feedback lines is located on an outer portion of each flexible film outside a mounting region of the flexible film where each gate driver is mounted.

In an embodiment, the plurality of feedback lines are connected to one of the data lines closest to the plurality of gate drivers.

In an embodiment, the plurality of feedback lines are located within a display area of the display panel and in parallel with the data lines.

In an embodiment, the plurality of feedback lines are connected to one of the data lines closest to the plurality of gate drivers.

In an embodiment, the at least one data driver includes a plurality of data drivers, and the plurality of feedback lines are connected to different ones of the data lines such that the plurality of measurement positions are disposed in a diagonal direction within the display area.

In an embodiment, a current one of the plurality of data drivers receive two feedback voltages of the plurality of feedback voltages through a first one of the plurality of feedback lines connected to a last data line of a previous one of the plurality of data drivers and a second one of the plurality of feedback lines connected to a last data line of the current one data driver, and measures a delay amount between the two feedback voltages.

In an embodiment, the display device further includes a controller configured to control the data driver and the plurality of gate drivers. The data driver provides the controller with information about the determined gate shift amounts at the plurality of measurement positions corresponding to the plurality of gate drivers, and the controller shifts a gate clock signal provided to the plurality of gate drivers such that the plurality of gate drivers apply gate signals that are shifted by the determined gate shift amounts to the gate lines corresponding to the plurality of measurement positions.

In an embodiment, the controller calculates gate shift amounts for the gate lines between the gate lines corresponding to the plurality of measurement positions by linearly interpolating the determined gate shift amounts at the plurality of measurement positions.

In an embodiment, the controller gradually increases gate shift amounts for the gate lines between the gate lines corresponding to the plurality of measurement positions according to a data voltage delay characteristic of the display device.

According to an exemplary embodiment of the inventive concept, there is provided a method of operating a display device including a plurality of gate drivers. In the method, a test voltage is applied to a data line of the display device, a plurality of feedback voltages are received through a plurality of feedback lines connected to the data line at a plurality of measurement positions corresponding to the plurality of gate drivers, gate shift amounts at the plurality of measurement positions corresponding to the plurality of gate drivers are determined based on the plurality of feedback voltages, and an image is displayed by applying gate signals to gate lines of the display device that are shifted by the determined gate shift amounts.

In an embodiment, to receive the plurality of feedback voltages through the plurality of feedback lines, one of the feedback voltages is received through a start gate feedback line connected to the data line at the measurement position corresponding to one of the gate lines closest to a data driver, and the remaining feedback voltages are received through a plurality of last gate feedback lines, each of the plurality of last gate feedback lines connected to the data line at the measurement position corresponding to a last gate line among a portion of the gate lines driven by a corresponding one of the plurality of gate drivers.

In an embodiment, to determine the gate shift amounts at the plurality of measurement positions, delay amounts of the remaining feedback voltages received through the plurality of last gate feedback lines with respect to the one feedback voltage received through the start gate feedback line are measured, and the gate shift amounts at the plurality of measurement positions are determined as the delay amounts of the plurality of feedback voltages.

In an embodiment, a portion of each of the plurality of feedback lines is formed on a plurality of flexible films on which the plurality of gate drivers are mounted.

According to an exemplary embodiment of the inventive concept, a display device is provided that includes a display panel, a data driver, a gate driver, a first feedback line, and a second feedback line. The display panel includes a plurality of data lines, a plurality of gate lines, and a plurality of pixels connected to the data lines and the gate lines. The data driver is configured to drive the data lines. The gate driver is configured to drive the gate lines. The first feedback line is connected to the first data driver and a first node on a first data line among the data lines nearest the gate driver at a first position of a first gate line among the gate lines nearest the data driver. The second feedback line is connected to the second data driver and a second node on the first data line at a second position of a last gate line among the gate lines farthest from the data driver. The data driver applies a test voltage to the first data line, samples the first feedback line to read a first feedback voltage, samples the second feedback line to read a second feedback voltage, and determines gate shift amounts from the read voltages. The gate driver applies gate signals to the gate lines that are shifted by the determined gate shift amounts.

In an embodiment, the data driver includes a first comparator configured to receive a reference voltage and the first feedback voltage, a second comparator configured to receive the reference voltage and the second feedback voltage, an XOR gate configured to receive an output from each of the comparators, and a counter configured to count an output of the XOR gate, where the data driver determines the gate shift amounts from an output of the counter.

In an embodiment, a portion of the second feedback line is wrapped around the gate driver.

In an embodiment, a portion of the feedback lines are arranged in an area between an edge of a display area of the display panel and the first data line.

As described above, a display device and a method of operating the display device according to at least one embodiments of the inventive concept includes at least one feedback line per each gate driver to measure data voltage delay amounts for respective gate drivers, and thus may automatically and accurately set gate shift amounts for the respective gate drivers.

BRIEF DESCRIPTION OF THE DRAWINGS

Exemplary embodiments of the inventive concept will be more clearly understood from the following detailed description taken in conjunction with the accompanying drawings.

DETAILED DESCRIPTION OF EXEMPLARY EMBODIMENTS

Figure 1:
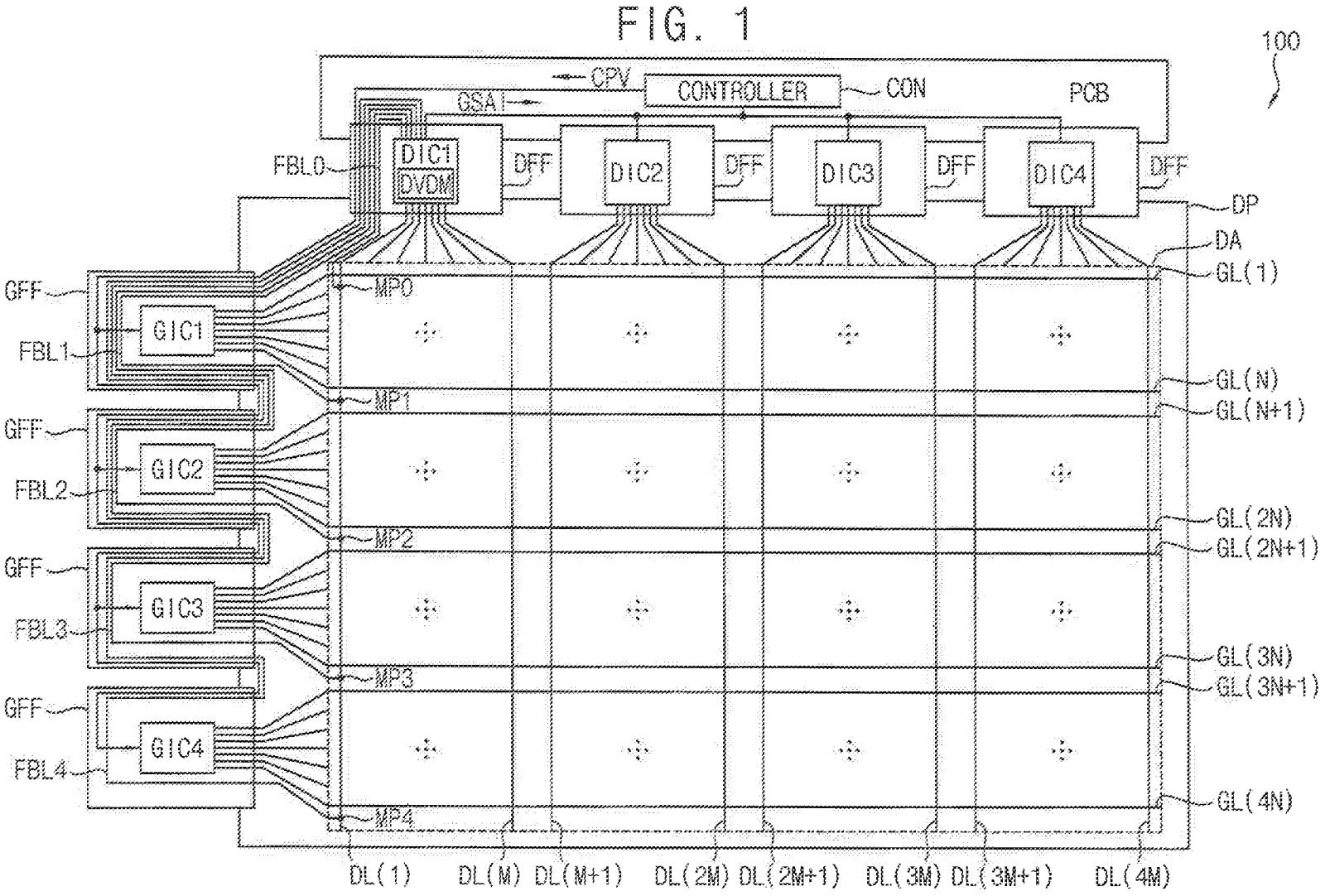
FIG. 1 is a diagram illustrating a display device according to an exemplary embodiment of the inventive concept.

Exemplary embodiments of the inventive concept are described more fully hereinafter with reference to the accompanying drawings. Like or similar reference numerals refer to like or similar elements throughout.

Figure 2:
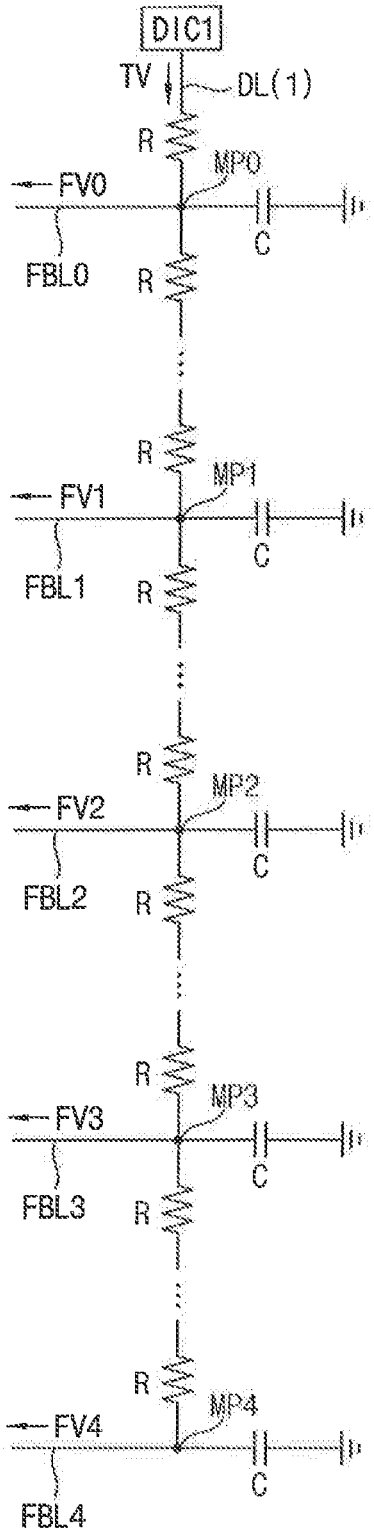
FIG. 2 is a diagram illustrating an example of an equivalent model of a first data line and a plurality of pixels connected to the first data line.
Figure 3:
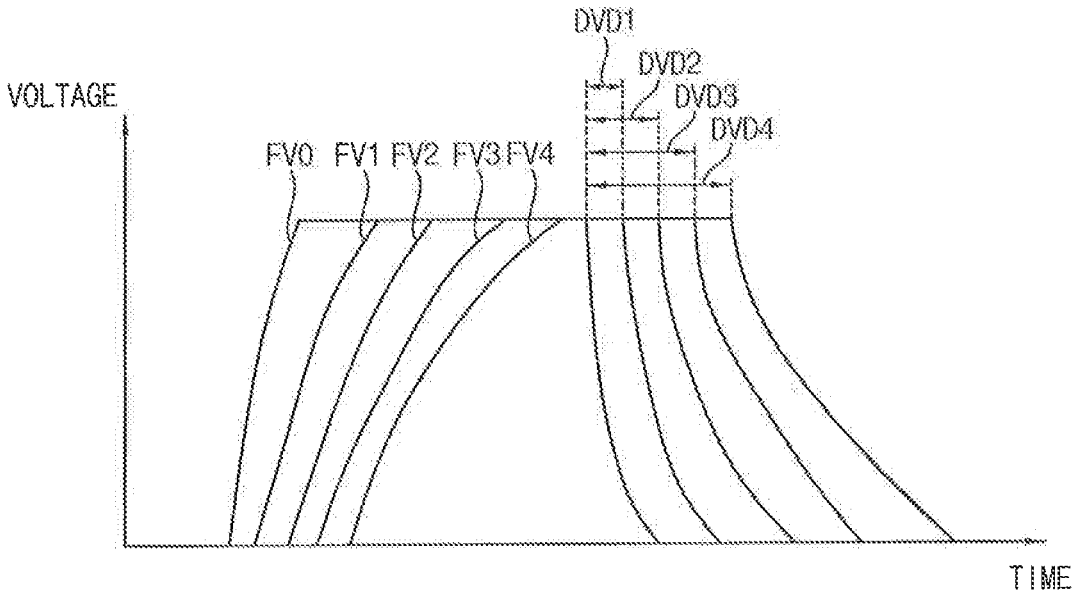
FIG. 3 is a timing diagram illustrating an example of a plurality of feedback voltages.
Figure 4:
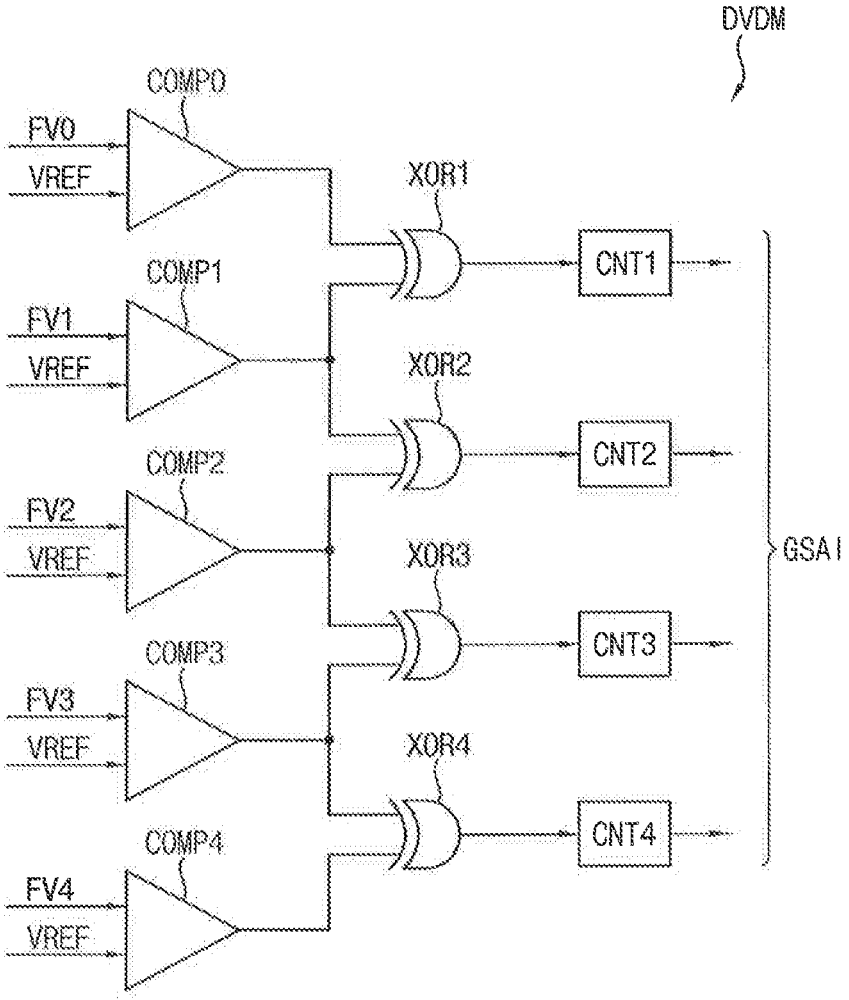
FIG. 4 is a block diagram illustrating an example of a data voltage delay measurer illustrated in FIG. 1.
Figure 5:
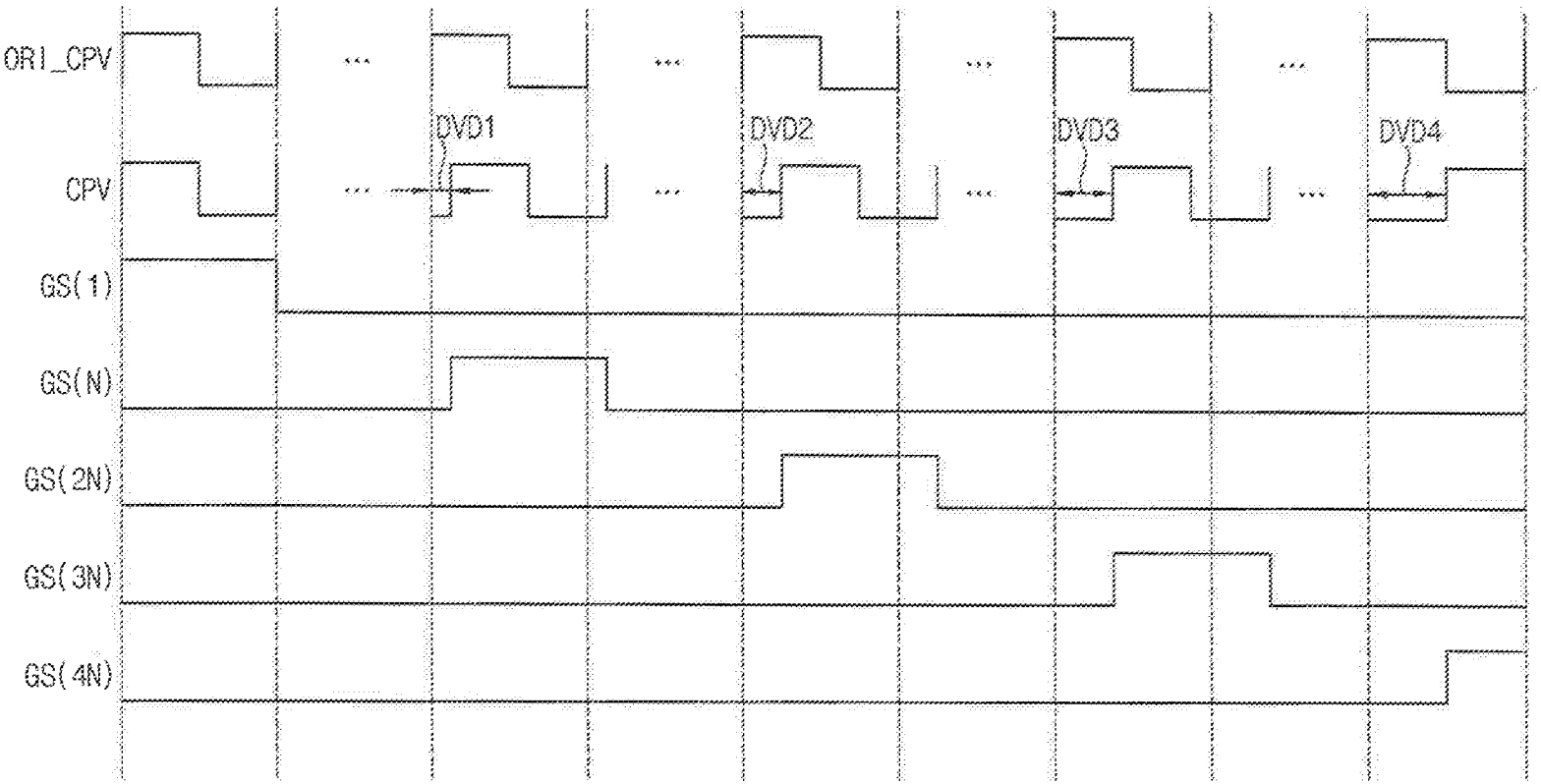
FIG. 5 is a timing diagram for describing an example where gate signals are shifted by shifting a gate clock signal.
Figure 6:
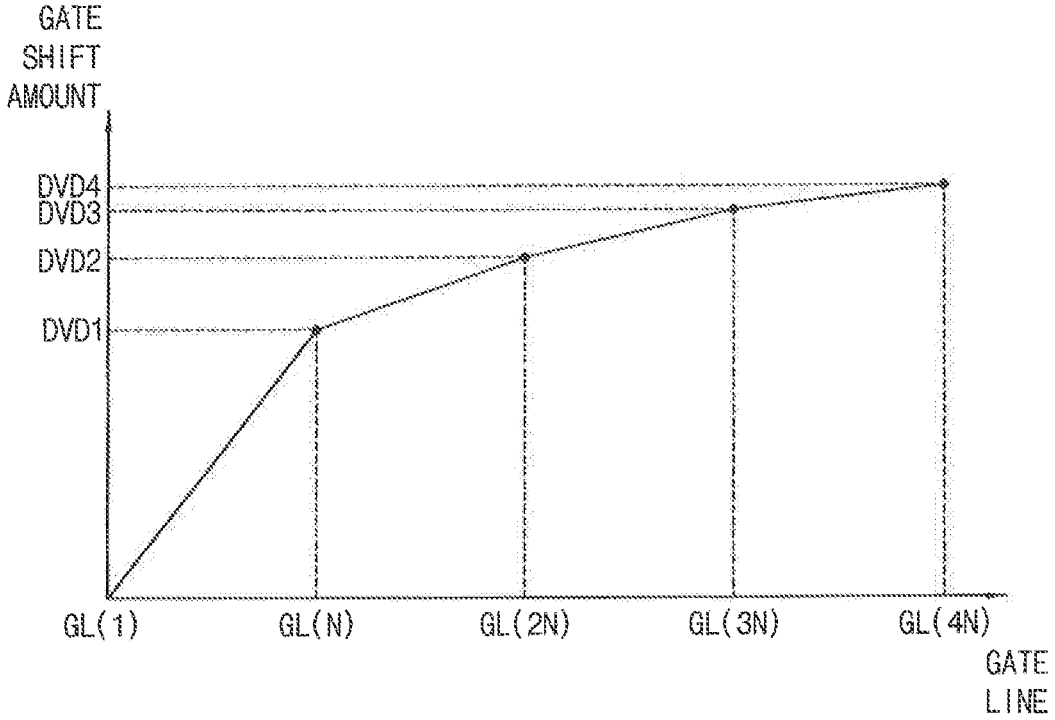
FIG. 6 is a graph illustrating an example of a gate shift amount according to a gate line.
Figure 7:
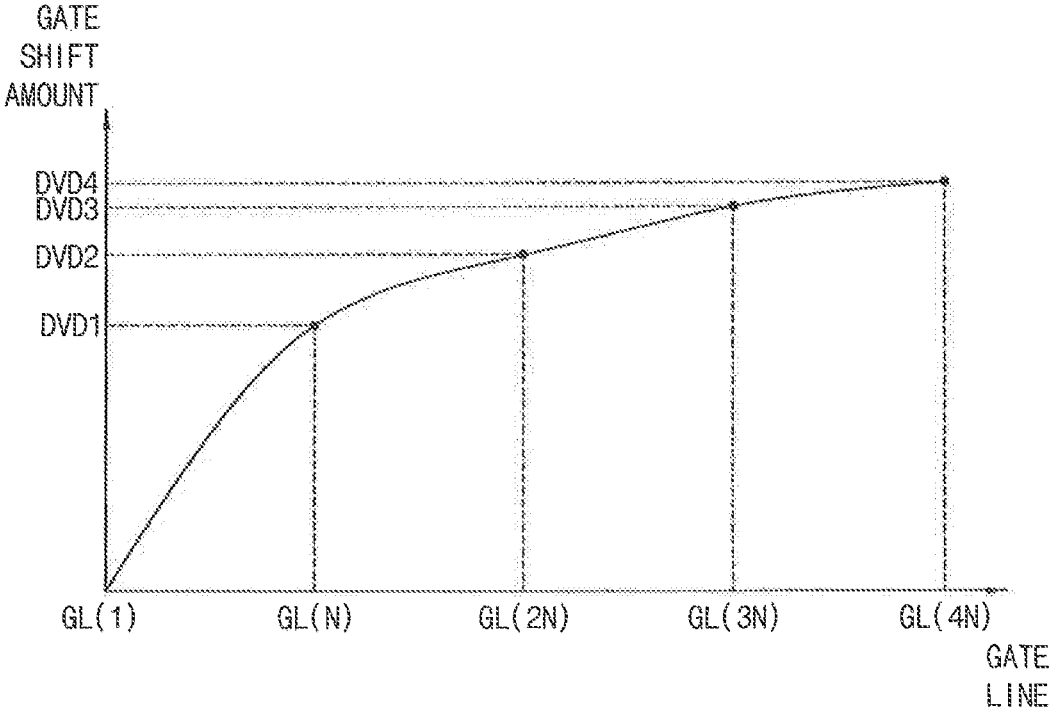
FIG. 7 is a graph illustrating another example of a gate shift amount according to a gate line.

FIG. 1 is a diagram illustrating a display device according to an exemplary embodiment of the inventive concept, FIG. 2 is a diagram illustrating an example of an equivalent model of a first data line and a plurality of pixels connected to the first data line, FIG. 3 is a timing diagram illustrating an example of a plurality of feedback voltages, FIG. 4 is a block diagram illustrating an example of a data voltage delay measurer illustrated in FIG. 1, FIG. 5 is a timing diagram for describing an example where gate signals are shifted by shifting a gate clock signal, FIG. 6 is a graph illustrating an example of a gate shift amount according to a gate line, and FIG. 7 is a graph illustrating another example of a gate shift amount according to a gate line.

Referring to FIG. 1, a display device 100 includes a display panel DP which includes a plurality of pixels within a display area DA, at least one data driver DIC1, DIC2, DIC3 and DIC4 (e.g., at least one data driving circuit) which provides data voltages to the plurality of pixels, a plurality of gate drivers GIC1, GIC2, GIC3 and GIC4 (e.g., a plurality of gate driver circuits) which provide gate signals to the plurality of pixels, a controller CON (e.g., a control circuit) which controls the data drivers DIC1, DIC2, DIC3 and DIC4 and the plurality of gate drivers GIC1, GIC2, GIC3 and GIC4, and a plurality of feedback lines FBL0, FBL1, FBL2, FBL3 and FBL4 connected to at least one data line DL(1). For example, the feedback lines FBL0-4 may be implemented with conductive material such as wires. In an embodiment, a portion of the first feedback line FBL0 is wrapped (or routed) around the first gate driver GIC1, a portion of the second feedback line FBL1 is wrapped (or routed) around the second gate driver GIC2, etc.

The display panel DP includes a plurality of data lines DL(1), DL(M), DL(M+1), DL(2M), DL(2M+1), DL(3M), DL(3M+1) and DL(4M), a plurality of gate lines GL(1), GL(N), GL(N+1), GL(2N), GL(2N+1), GL(3N), GL(3N+1) and GL(4N), and the plurality of pixels connected to the plurality of data lines DL(1) through DL(4M) and the plurality of gate lines GL(1) through GL(4N). In an exemplary embodiment, each pixel includes a switching transistor, and a liquid crystal capacitor connected to the switching transistor, and the display panel DP is a liquid crystal display (LCD) panel. However, the display panel DP is not limited to a LCD panel, and may be any other type of display panel.

The data drivers DIC1, DIC2, DIC3 and DIC4 generate the data voltages based on image data and a data control signal provided from the controller CON, and apply the data voltages to the data lines DL(1) through DL(4M). For example, the data control signal may include, but is not limited to, a horizontal start signal, a load signal, etc. In FIG. 1, the display device 100 includes four data drivers DIC1, DIC2, DIC3 and DIC4, each of which drives M data lines. For example, the first data driver DIC1 drives a first data line DL(1) through an M-th data line DL(M)), where M is an integer greater than 1. However, the number of the data drivers DIC1, DIC2, DIC3 and DIC4 is not limited to 4 since the display device 100 according to exemplary embodiments may include any number of data drivers.

In an exemplary embodiment, each of the data drivers DIC1, DIC2, DIC3 and DIC4 is implemented by an integrated circuit (IC). In an embodiment, each IC is mounted on a flexible film DFF attached to the display panel DP. For example, each of the data drivers DIC1, DIC2, DIC3 and DIC4 may be mounted in a chip-on-film (COF) type or a tape automated bonding (TAB) type on the flexible film DFF.

The plurality of gate drivers GIC1, GIC2, GIC3 and GIC4 generate the gate signals based on a gate control signal. In an embodiment, the gate control signal is provided from the controller CON. In an embodiment, the gate drivers GIC1, GIC2, GIC3, and GIC4 sequentially apply the gate signals to the plurality of gate lines GL(1) through GL(4N). For example, the gate control signal may include, but is not limited to, a gate clock signal CPV, a scan start pulse, etc. In FIG. 1, the display device 100 includes four gate drivers GIC1, GIC2, GIC3 and GIC4, and each of the gate drivers drives N data lines. For example, the first gate driver GIC1 drives a first gate line GL(1) through an N-th data line GL(N)), where N is an integer greater than 1. However, the number of the gate drivers GIC1, GIC2, GIC3 and GIC4 is not limited to 4 since the display device 100 according to exemplary embodiments may include any number of gate drivers greater than 1.

In an exemplary embodiment, each of the gate drivers GIC1, GIC2, GIC3 and GIC4 is implemented as an IC. In an embodiment, each IC is mounted on a flexible film GFF attached to the display panel DP. For example, each of the gate drivers GIC1, GIC2, GIC3 and GIC4 may be mounted in the COF type or the TAB type on the flexible film GFF.

The controller CON may receive image data and a control signal from an external host (e.g., a graphic processing unit (GPU)). In an exemplary embodiment, the image data is RGB data including red image data, green image data and blue image data. The control signal may include, but is not limited to, a data enable signal, a master clock signal, etc. The controller CON may generate the gate control signal, the data control signal and output image data based on the control signal and the image data. The controller CON may control an operation of the data drivers DIC1, DIC2, DIC3 and DIC4 by providing the data control signal and the output image data to the data driver DIC1, DIC2, DIC3 and DIC4, and may control an operation of the gate drivers GIC1, GIC2, GIC3 and GIC4 by providing the gate control signal to the gate drivers GIC1, GIC2, GIC3 and GIC4. In an exemplary embodiment, the controller CON is a timing controller (TCON) (e.g., a timing control circuit). Further, in an exemplary embodiment, as illustrated in FIG. 1, the controller CON is disposed on a circuit board PCB to which the flexible film DFF for the data driver DIC1, DIC2, DIC3 and DIC4 is attached. For example, the circuit board PCB may be a printed circuit board or a flexible printed circuit board.

In an embodiment, one end of each of the plurality of feedback lines FBL0, FBL1, FBL2, FBL3 and FBL4 is connected to the first data line DL(1) at desired or predetermined measurement positions MP0, MP1, MP2, MP3 and MP4 (e.g., measurement points or nodes), and the other end of each of the plurality of feedback lines FBL0, FBL1, FBL2, FBL3 and FBL4 is connected to the first data driver DIC1. At least a portion FBL1, FBL2, FBL3 and FBL4 of the plurality of feedback lines FBL0, FBL1, FBL2, FBL3 and FBL4 is connected to the first data line DL(1) at a plurality of measurement positions MP1, MP2, MP3 and MP4 respectively corresponding to the plurality of gate drivers GIC1, GIC2, GIC3 and GIC4. For example, the first feedback line FBL0 may be connected to a first node MP0 along a data line (e.g., DL(1)) nearest a gate driver at a position on or near a first gate line (e.g., GL(1)) of the first gate driver GIC1 nearest a data driver and the second feedback line FBL1 may be connected to a second node MP1 along the same data line at a position on or near a last gate line (e.g., GL(N)) of the first gate driver GIC1.

In an exemplary embodiment, as illustrated in FIG. 1, the plurality of feedback lines FBL0, FBL1, FBL2, FBL3 and FBL4 include a plurality of last gate feedback lines FBL1, FBL2, FBL3 and FBL4 and a start gate feedback line FBL0. In an embodiment, each of the last gate feedback lines is connected to the first data line DL(1) at respective measurement positions MP1, MP2, MP3, and MP4 corresponding to a last gate line. For example, a last gate line may be a farthest gate line from a given one of the data driver DIC1, DIC2, DIC3 and DIC4, for example, GL(N)) among a portion of the gate lines (e.g., GL(1) through GL(N)) driven by a corresponding one (e.g., GIC1) of the plurality of gate drivers GIC1, GIC2, GIC3 and GIC4. In an embodiment, a measurement position corresponds to a position of or near the last gate line within a group of gate lines controlled by a given gate driver. For example, MP2 may correspond to a position at or near gate line GL(2N), which is the last gate line controlled by gate driver GIC2, MP3 may correspond to a position at or near gate line GL(3N), which is the last gate line controlled by gate driver GIC3, etc. In an embodiment, the start gate feedback line FBL0 is connected to the first data line DL(1) at a measurement position MP0 corresponding to a gate line GL(1) closest to the data drivers DIC1, DIC2, DIC3 and DIC4. For example, MP0 may correspond to a position at or near gate line GL(1), which is the first gate line controlled by gate driver GIC1.

In an exemplary embodiment, as illustrated in FIG. 1, the plurality of feedback lines FBL1, FBL2, FBL3 and FBL4 are implemented with film wirings formed on a plurality of flexible films GFF on which the plurality of gate drivers GIC1, GIC2, GIC3 and GIC4 are mounted. For example, as illustrated in FIG. 1, at least a portion of each of the feedback lines FBL1, FBL2, FBL3 and FBL4 are formed on an outer portion of each flexible film GFF outside a mounting region (e.g., in an opposite direction to the display panel (DP)) where each gate driver is mounted. In an embodiment where the plurality of gate feedback lines FBL1, FBL2, FBL3 and FBL4 are implemented with the film wirings, as illustrated in FIG. 1, the plurality of gate feedback lines FBL1, FBL2, FBL3 and FBL4 are connected to the first data line DL(1) closest to the plurality of gate drivers GIC1, GIC2, GIC3 and GIC4 so that wiring lengths of the plurality of gate feedback lines FBL1, FBL2, FBL3 and FBL4 can be as short as possible. However, the inventive concept is not limited thereto. For example, the gate feedback lines FBL1-FBL4 could instead be connected to a different one of the data lines such as DL(2), DL(3), etc. As described above, in some exemplary embodiments, the plurality of feedback lines FBL1, FBL2, FBL3 and FBL4 are implemented as the film wirings (or to include the film wirings), and thus an aperture ratio of the display panel DP is not reduced.

The data voltages output from the data drivers DIC1, DIC2, DIC3 and DIC4 may be delayed according to distances of the pixels from the data driver DIC1, DIC2, DIC3 and DIC4. For example, as illustrated in FIG. 2, a first data line DL(1) and a plurality of pixels connected to the first data line DL(1) may be represented as an equivalent model including resistors R connected in series and capacitors C connected to the resistors R. The data voltages may be delayed by a resistor-capacitor (RC) delay of the resistors R and the capacitors C, and delay amounts of the data voltages may be increased according to the distances of the pixels. Due to the RC delay, a mismatch between an on period of the gate signal and a high period of the data voltage may occur, and thus a charging rate of a pixel may be decreased as the distance of the pixel from the data drivers DIC1, DIC2, DIC3 and DIC4 increases, which results in deterioration of image quality.

To prevent the deterioration of image quality caused by the RC delay, the display device 100 according to an exemplary embodiment of the inventive concept measures a data voltage delay amount at one or more measurement positions MP1, MP2, MP3 and MP4 per each gate driver GIC1, GIC2, GIC3 and GIC4 using the feedback lines FBL1, FBL2, FBL3 and FBL4, and automatically and accurately sets gate shift amounts of the gate signals based on the data voltage delay amounts at the plurality of measurement positions MP1, MP2, MP3 and MP4 respectively corresponding to the plurality of the gate drivers GIC1, GIC2, GIC3 and GIC4. For example, the period during which a gate signal applied to a given gate line is activated to enable a pixel connected to the given gate line to receive a data voltage from a data driver can be shifted (advanced) to coincide with the time at which the data voltage reaches a desired voltage level.

To automatically set the gate shift amounts, at least one data driver (e.g., DIC1) applies a test voltage TV to at least one data line (e.g., DL(1)), and receives the test voltage TV as a plurality of feedback voltages FV0, FV1, FV2, FV3 and FV4 through the plurality of feedback lines FBL0, FBL1, FBL2, FBL3 and FBL4 connected to the data line DL(1) at the plurality of measurement positions MP0, MP1, MP2, MP3 and MP4. In an exemplary embodiment, as illustrated in FIGS. 1 and 2, the display device 100 includes the start gate feedback line FBL0 connected to the data line DL(1) at the measurement position MP0 corresponding to the gate line GL(1) closest to the data driver DIC1 and the plurality of last gate feedback lines FBL1, FBL2, FBL3 and FBL4 connected to the data line DL(1) at the measurement positions MP1, MP2, MP3 and MP4 corresponding to last gate lines GL(N), GL(2N), GL(3N) and GL(4N) of the plurality of gate drivers GIC1, GIC2, GIC3 and GIC4. The data driver DIC1 receives the plurality of feedback voltages FV0, FV1, FV2, FV3 and FV4 through the start gate feedback line FBL0 and the plurality of last gate feedback lines FBL1, FBL2, FBL3 and FBL4.

The data driver DIC1 measures the data voltage delay amounts at the measurement positions MP1, MP2, MP3 and MP4 respectively corresponding to the plurality of gate drivers GIC1, GIC2, GIC3 and GIC4 based on the plurality of feedback voltages FV0, FV1, FV2, FV3 and FV4 received through the plurality of feedback lines FBL0, FBL1, FBL2, FBL3 and FBL4. For example, as illustrated in FIGS. 1 through 3, the plurality of feedback voltages FV1, FV2, FV3 and FV4 received through the plurality of last gate feedback lines FBL1, FBL2, FBL3 and FBL4 may be more delayed than the feedback voltage FV0 (hereinafter, referred to as a 'start gate feedback voltage') received through the start gate feedback line FBL0. In an embodiment, the data driver DIC1 measures data voltage delay amounts DVD1, DVD2, DVD3 and DVD4 of the plurality of feedback voltages FV1, FV2, FV3 and FV4 received through the plurality of last gate feedback lines FBL1, FBL2, FBL3 and FBL4 with respect to the start gate feedback voltage FV0, or the data voltage delay amounts DVD1, DVD2, DVD3 and DVD4 at the measurement positions MP1, MP2, MP3 and MP4 respectively corresponding to the plurality of gate drivers GIC1, GIC2, GIC3 and GIC4. For example, if the start gate feedback voltage FV0 has a desired voltage at a first time and the feedback voltage FV1 has the desired voltage at a second time, then the data voltage delay amount DVD1 could be determined by subtracting the second time from the first time.

In an exemplary embodiment, the data driver DIC1 includes a data voltage delay measurer DVDM which measures the data voltage delay amounts DVD1, DVD2, DVD3 and DVD4 at the measurement positions MP1, MP2, MP3 and MP4. In an exemplary embodiment, as illustrated in FIG. 4, the data voltage delay measurer DVDM includes a plurality of comparators COMP0, COMP1, COMP2, COMP3 and COMP4 (e.g., comparator circuits), a plurality of XOR gates XOR1, XOR2, XOR3 and XOR4, and a plurality of counters CNT1, CNT2, CNT3 and CNT4 (e.g., count circuits). The comparators COMP0, COMP1, COMP2, COMP3 and COMP4 compare the plurality of feedback voltages FV0, FV1, FV2, FV3 and FV4 received through the start gate feedback line FBL0 and the plurality of last gate feedback lines FBL1, FBL2, FBL3 and FBL4 with a reference voltage VREF. The plurality of XOR gates XOR1, XOR2, XOR3 and XOR4 each perform an XOR operation on two adjacent output signal lines among a plurality of output signals output by the plurality of comparators COMP0, COMP1, COMP2, COMP3 and COMP4. The plurality of counters CNT1, CNT2, CNT3 and CNT4 count high periods of a plurality of output signals output by the plurality of XOR gates XOR1, XOR2, XOR3 and XOR4. For example, a counter can increment itself each time it samples a logic high output by a corresponding XOR gate. For example, the logic high could indicate that two feedback voltages applied to comparators providing their outputs to the XOR gate are delayed from one another. However, the data voltage measurer DVDM is not limited to the embodiment illustrated in FIG. 4. A test voltage may be applied to the data line DL(1), and then the data voltage delay measurer DVDM can sample the start feedback line FBL0 and the last gate feedback lines FBL1-FBL4 to read feedback voltages that can be used to determine data voltage delay amounts.

In the embodiment illustrated in FIG. 4, an output signal of each counter CNT1, CNT2, CNT3 and CNT4 represents a delay amount between two adjacent feedback voltages. For example, a first counter CNT1 may output an output signal representing a delay amount DVD1 of the feedback voltage FV1 at a first measurement position MP1 from the start gate feedback voltage FV0, a second counter CNT2 may output an output signal representing a delay amount (i.e., DVD2-DVD1) of the feedback voltage FV2 at a second measurement position MP2 from the feedback voltage FV1 at the first measurement position MP1, a third counter CNT3 may output an output signal representing a delay amount (i.e., DVD3-DVD2) of the feedback voltage FV3 at a third measurement position MP3 from the feedback voltage FV2 at the second measurement position MP2, and a fourth counter CNT4 may output an output signal representing a delay amount (i.e., DVD4-DVD3) of the feedback voltage FV4 at a fourth measurement position MP4 from the feedback voltage FV3 at the third measurement position MP3.

The data driver DIC1 may obtain the delay amounts DVD1, DVD2, DVD3 and DVD4 of the plurality of feedback voltages FV1, FV2, FV3 and FV4 at the plurality of measurement positions MP1, MP2, MP3 and MP4 with respect to the start gate feedback voltage FV0 based on these delay amounts DVD1, DVD2-DVD1, DVD3-DVD2 and DVD4-DVD3 between the plurality of feedback voltages FV0, FV1, FV2, FV3 and FV4. The data driver DIC1 may determine gate shift amounts at the plurality of measurement positions MP1, MP2, MP3 and MP4 respectively corresponding to plurality of gate drivers GIC1, GIC2, GIC3 and GIC4 as the delay amounts DVD1, DVD2, DVD3 and DVD4 of the plurality of feedback voltages FV1, FV2, FV3 and FV4. Further, the data driver DIC1 may provide the controller CON with information GSAI about the determined gate shift amounts (or the data voltage delay amounts DVD1, DVD2, DVD3 and DVD4) at the plurality of measurement positions MP1, MP2, MP3 and MP4 of the plurality of gate drivers GIC1, GIC2, GIC3 and GIC4. In an embodiment, during a new measurement period, a counter (e.g., CNT1) is reset and then incremented each time the counter receives a logic high (e.g. during a logic high period) from a corresponding XOR gate (e.g., XOR1). The measurement period may begin when a test voltage is applied to the data line connected to the measurement positions MP1, MP2, MP3, and MP4. The count of the counter may correspond to a delay amount. For example, the higher the count, the higher the delay amount. For example, the information GSAI may include the counts of all the counters during a given measurement period.

In an exemplary embodiment, based on the information GSAI about the determined gate shift amounts (or the data voltage delay amounts DVD1, DVD2, DVD3 and DVD4) at the plurality of measurement positions MP1, MP2, MP3 and MP4, the controller CON shifts a gate clock signal CPV provided to the plurality of gate drivers GIC1, GIC2, GIC3 and GIC4 such that the plurality of gate drivers GIC1, GIC2, GIC3 and GIC4 apply gate signals that are shifted by the determined gate shift amounts to the gate lines GL(N), GL(2N), GL(3N) and GL(4N) corresponding to the plurality of measurement positions MP1, MP2, MP3 and MP4. For example, as illustrated in FIG. 5, the controller CON outputs the gate clock signal CPV at substantially the same time as an original gate clock signal ORI_CPV when a first gate driver GIC1 outputs a first gate signal GS(1) to a first gate line GL(1). The controller CON shifts (or delays) the gate clock signal CPV by the determined gate shift amount at the first measurement point MP1 (or the delay amount DVD1 of the feedback voltage FV1 at the first measurement position MP1 with respect to the start gate feedback voltage FV0 from the original gate clock signal ORI_CPV when the first gate driver GIC1 outputs an N-th gate signal GS(N) to an N-th gate line GL(N). The controller CON shifts (or delays) the gate clock signal CPV by the determined gate shift amount at the second measurement point MP2 (or the delay amount DVD2 of the feedback voltage FV2 at the second measurement position MP2 with respect to the start gate feedback voltage FV0) from the original gate clock signal ORI_CPV when a second gate driver GIC2 outputs a 2N-th gate signal GS(2N) to a 2N-th gate line GL(2N). The controller CON shifts (or delays) the gate clock signal CPV by the determined gate shift amount at the third measurement point MP3 (or the delay amount DVD3 of the feedback voltage FV3 at the third measurement position MP3 with respect to the start gate feedback voltage FV0) from the original gate clock signal ORI_CPV when a third gate driver GIC3 outputs a 3N-th gate signal GS(3N) to a 3N-th gate line GL(3N). The controller CON shifts (or delays) the gate clock signal CPV by the determined gate shift amount at the fourth measurement point MP4 (or the delay amount DVD4 of the feedback voltage FV4 at the fourth measurement position MP4 with respect to the start gate feedback voltage FV0) from the original gate clock signal ORI_CPV when a fourth gate driver GIC4 outputs a 4N-th gate signal GS(4N) to a 4N-th gate line GL(4N).

Further, in an exemplary embodiment, the controller CON gradually shifts the gate clock signal CPV such that the gate signals applied to the gate lines between the plurality of measurement positions MP0, MP1, MP2, MP3 and MP4 are gradually shifted.

In an exemplary embodiment, as illustrated in FIG. 6, the controller CON calculates gate shift amounts for the gate lines between the gate lines GL(1), GL(N), GL(2N), GL(3N) and GL(4N) corresponding to the plurality of measurement positions MP0, MP1, MP2, MP3 and MP4 by linearly interpolating the determined gate shift amounts DVD1, DVD2, DVD3 and DVD4 at the plurality of measurement positions MP0, MP1, MP2, MP3 and MP4. For example, the controller CON may linearly increase a shift amount of the gate clock signal CPV from 0 to the determined gate shift amount (i.e., DVD1) at the first measurement position MP1 from when the first gate driver GIC1 outputs the first gate signal GS(1) to the first gate line GL(1) until the first gate driver GIC1 outputs the N-th gate signal GS(N) to the N-th gate line GL(N), may linearly increase the shift amount of the gate clock signal CPV to the determined gate shift amount (i.e., DVD2) at the second measurement position MP2 until the second gate driver GIC2 outputs the 2N-th gate signal GS(2N) to the 2N-th gate line GL(2N), may linearly increase the shift amount of the gate clock signal CPV to the determined gate shift amount (i.e., DVD3) at the third measurement position MP3 until the third gate driver GIC3 outputs the 3N-th gate signal GS(3N) to the 3N-th gate line GL(3N), and may linearly increase the shift amount of the gate clock signal CPV to the determined gate shift amount (i.e., DVD4) at the fourth measurement position MP4 until the fourth gate driver GIC4 outputs the 4N-th gate signal GS(4N) to the 4N-th gate line GL(4N). For example, the gate shift amounts DVD1-DVD4 may be plotted against indexes of boundary gate lines (e.g., GL(1), GL(N), GL(2N)) at or near the corresponding measurement positions to create a plurality of line segments, and then a gate shift amount of a given gate line between a pair of consecutive boundary gate lines (e.g., GL(1) and GL(N)) can be determined from mapping the index of the given gate line to a corresponding gate shift amount on a corresponding one of the line segments. In an embodiment, a linear equation having a particular slope is determined for each line segment, and the index of the given gate line is input to the linear equation to determine the corresponding gate shift amount.

In an exemplary embodiment, as illustrated in FIG. 7, the controller CON gradually increases gate shift amounts for the gate lines between the gate lines GL(1), GL(N), GL(2N), GL(3N) and GL(4N) corresponding to the plurality of measurement positions MP0, MP1, MP2, MP3 and MP4 according to a data voltage delay characteristic of the display device 100. For example, the controller CON may previously store information about a model (e.g., a high order function model or an exponential function model) for the data voltage delay characteristic of the display device 100, may correct or adjust the model using the determined gate shift amounts at the plurality of measurement positions MP0, MP1, MP2, MP3 and MP4, and may gradually shift the gate clock signal CPV using the corrected model.

As described above, the display device 100 according to an exemplary embodiment of the inventive concept includes at least one feedback line FBL1, FLB2, FBL3 and FBL4 per each gate driver GIC1, GIC2, GIC3 and GIC4 to measure the data voltage delay amounts DVD1, DVD2, DVD3 and DVD4 at the respective measurement positions MP1, MP2, MP3 and MP4 corresponding to the respective gate drivers GIC1, GIC2, GIC3 and GIC4, and thus may automatically and accurately set the gate shift amounts for the respective gate drivers GIC1, GIC2, GIC3 and GIC4. Further, the display device 100 may output the gate signals that are shifted (or delayed) by the data voltage delay amounts due to the RC delay according to the distance of a pixel, thereby preventing reduction of a charging rate of the pixel and deterioration of image quality according to the distance from the data driver DIC1, DIC2, DIC3 and DIC4.

Figure 8:
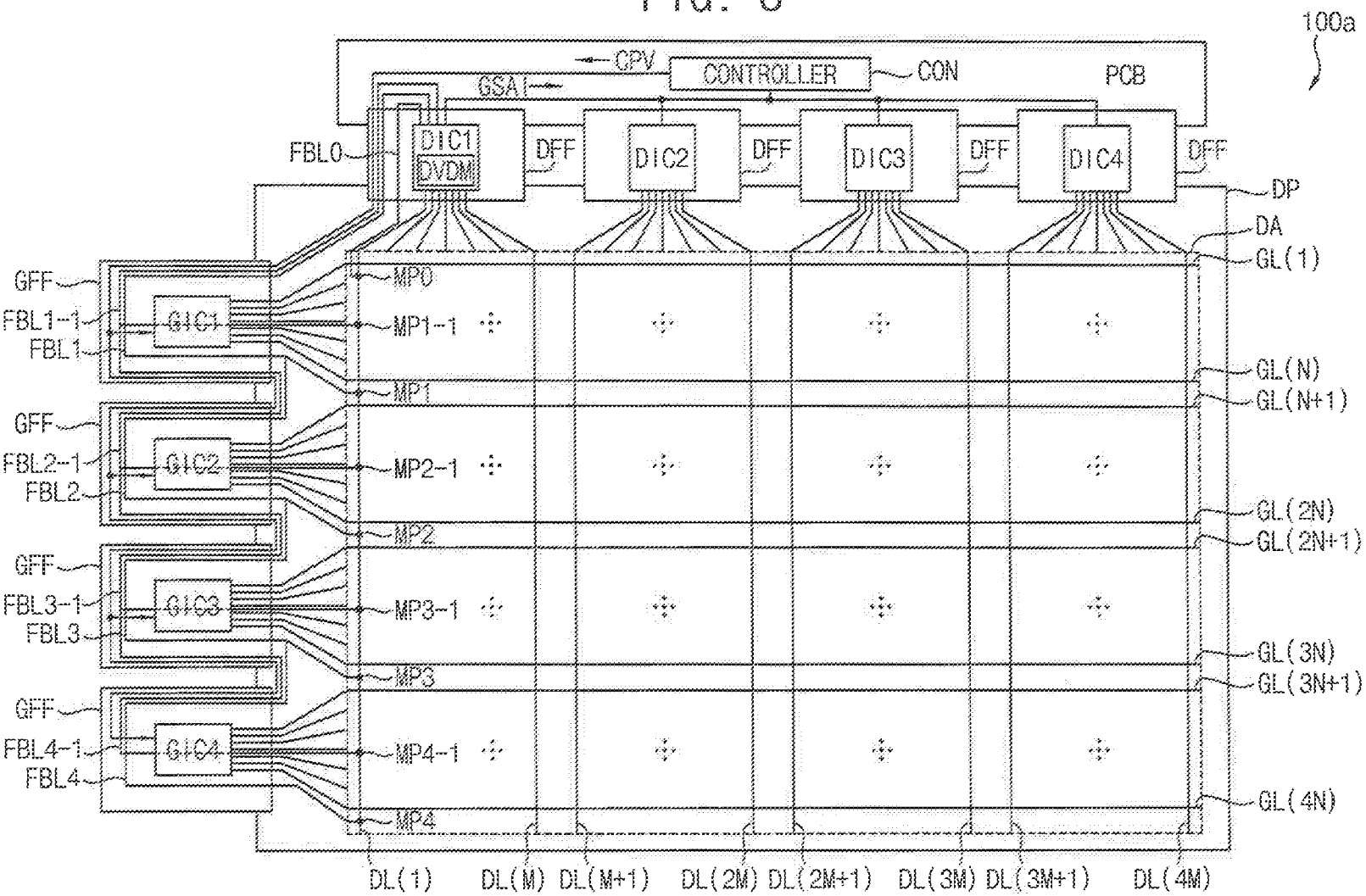
FIG. 8 is a diagram illustrating a display device according to an exemplary embodiment of the inventive concept.
Figure 9:
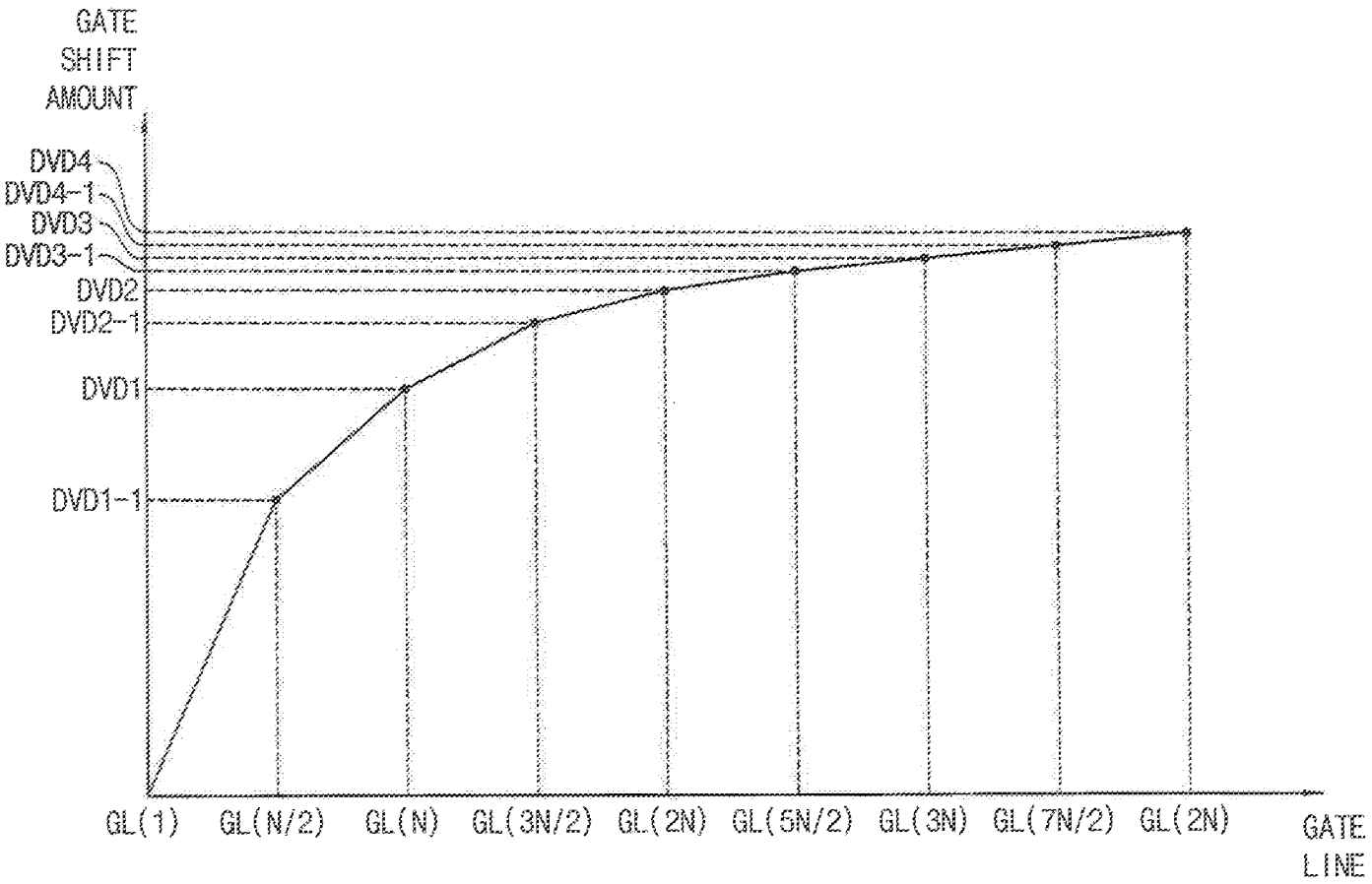
FIG. 9 is a graph illustrating an example of a gate shift amount according to a gate line.

FIG. 8 is a diagram illustrating a display device according to an exemplary embodiment of the inventive concept, and FIG. 9 is a graph illustrating an example of a gate shift amount according to a gate line.

Referring to FIG. 8, a display device 100*a* includes a display panel DP having a plurality of pixels within a display area DA, a plurality of data drivers DIC1, DIC2, DIC3 and DIC4 providing data voltages to the plurality of pixels, a plurality of gate drivers GIC1, GIC2, GIC3 and GIC4 providing gate signals to the plurality of pixels, a controller CON controlling the data drivers DIC1, DIC2, DIC3 and DIC4 and the plurality of gate drivers GIC1, GIC2, GIC3 and GIC4, and a plurality of feedback lines FBL0, FBL1-1, FBL1, FBL2-1, FBL2, FBL3-1, FBL3, FBL4-1 and FBL4 connected to a first data line DL(1). The display device 100*a* of FIG. 8 may have substantially the same configuration and operation as a display device 100 of FIG. 1, except that the display device 100*a* further includes at least one feedback line FBL1-1, FBL2-1, FBL3-1 and FBL4-1 per each gate driver GIC1, GIC2, GIC3 and GIC4. In FIG. 8, for convenience of illustration, the feedback lines FBL1, FLB2, FBL3 and FBL4 are simplified as a single line, and the additional feedback lines FBL1-1, FBL2-1, FBL3-1 and FBL4-1 are simplified as a single line.

The display device 100*a* of FIG. 8 may include, as the plurality of feedback lines FBL0, FBL1-1, FBL1, FBL2-1, FBL2, FBL3-1, FBL3, FBL4-1 and FBL4 connected to the data line DL(1), not only a start gate feedback line FBL0 and a plurality of last gate feedback lines FBL1, FBL2, FBL3 and FBL4, but also a plurality of middle gate feedback lines FBL1-1, FBL2-1, FBL3-1 and FBL4-1. Each middle gate feedback line (e.g., FBL1-1) may be connected to the data line DL(1) at a measurement position (e.g., MP1-1) corresponding to a middle gate line (e.g., GL(N/2) among a portion (e.g., GL(1) through GL(N)) of gate lines GL(1) through GL(4N) driven by a corresponding gate driver (e.g., GIC1). Accordingly, as illustrated in FIG. 9, the display device 100*a* may measure not only data voltage delay amounts DVD1, DVD2, DVD3 and DVD4 at measurement positions MP1, MP2, MP3 and MP4 (e.g., measurement points) corresponding to last gate lines GL(N), GL(2N), GL(3N) and GL(4N) of the plurality of gate drivers GIC1, GIC2, GIC3 and GIC4, but also data voltage delay amounts DVD1-1, DVD2-1, DVD3-1 and DVD4-1 at measurement positions MP1-1, MP2-1, MP3-1 and MP4-1 (e.g., measurement points) corresponding to middle gate lines GL(N/2), GL(3N/2), GL(5N/2) and GL(7N/2) of the plurality of gate drivers GIC1, GIC2, GIC3 and GIC4, and may set gate shift amounts at a plurality of measurement positions MP1-1, MP1, MP2-1, MP2, MP3-1, MP3, MP4-1 and MP4 (e.g., measurement positions) as the measured data voltage delay amounts DVD1-1, DVD1, DVD2-1, DVD2, DVD3-1, DVD3, DVD4-1 and DVD4. Accordingly, the gate shift amounts may be more accurately set, and a reduction of a charging rate of a pixel and a deterioration of an image quality may be further prevented.

Figure 10:
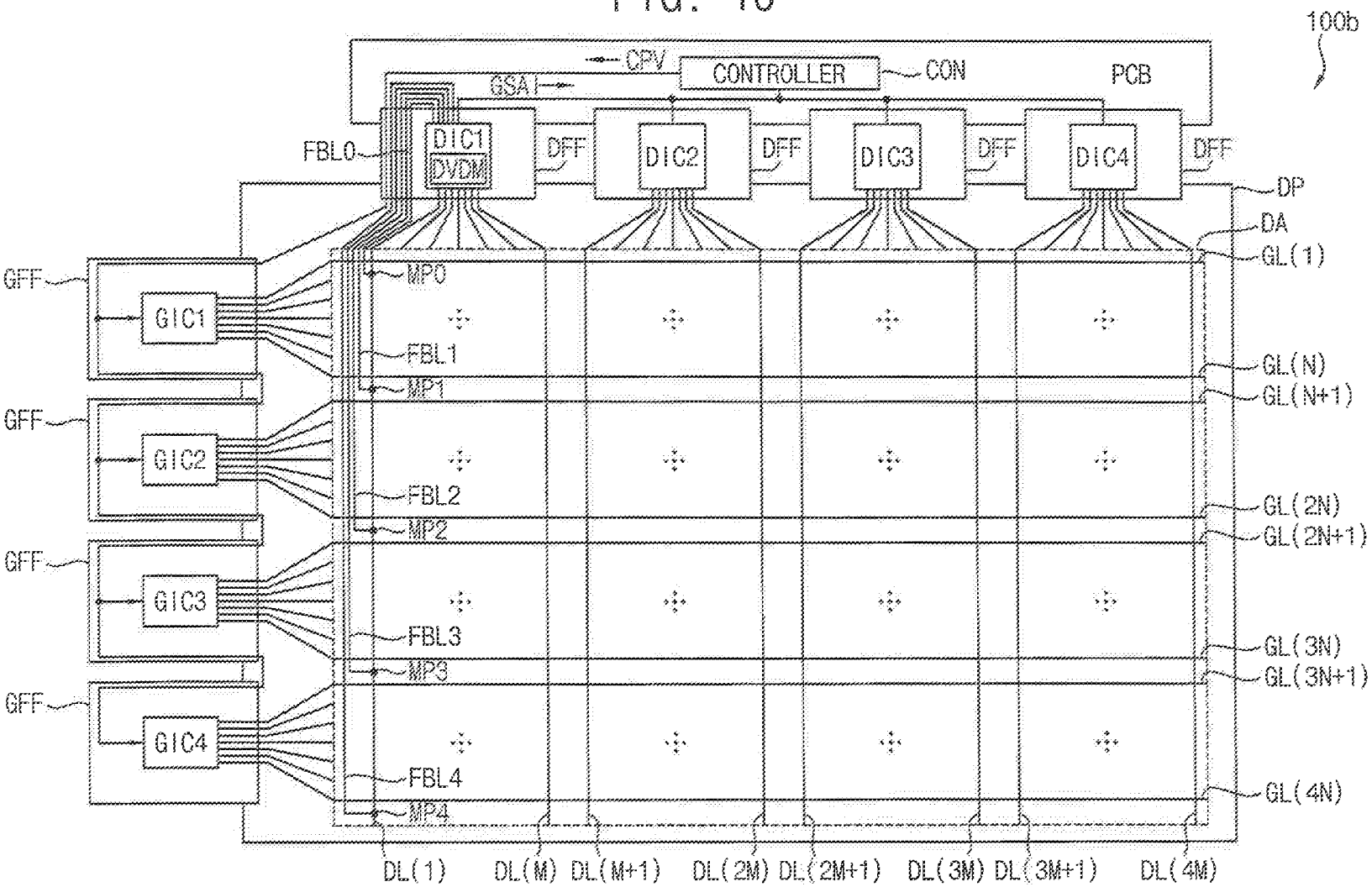
FIG. 10 is a diagram illustrating a display device according to an exemplary embodiment of the inventive concept.

FIG. 10 is a diagram illustrating a display device according to an exemplary embodiment of the inventive concept.

Referring to FIG. 10, a display device 100*b* includes a display panel DP having a plurality of pixels within a display area DA, a plurality of data drivers DIC1, DIC2, DIC3 and DIC4 providing data voltages to the plurality of pixels, a plurality of gate drivers GIC1, GIC2, GIC3 and GIC4 providing gate signals to the plurality of pixels, a controller CON which controls the data drivers DIC1, DIC2, DIC3 and DIC4 and the plurality of gate drivers GIC1, GIC2, GIC3 and GIC4, and a plurality of feedback lines FBL0, FBL1, FBL2, FBL3 and FBL4 connected to first data line DL(1). The feedback lines FBL0-FBL4 are not limited to being connected to the first data line DL(1) and could instead be connected any other data line such as DL(2), DL(3), etc. in alternate embodiments. The display device 100*b* of FIG. 10 may have substantially the same configuration and operation as a display device 100 of FIG. 1, except that the plurality of feedback lines FBL0, FBL1, FBL2, FBL3 and FBL4 are located within the display panel DP.

In an exemplary embodiment, as illustrated in FIG. 10, the plurality of feedback lines FBL1, FBL2, FBL3 and FBL4 are located within a display area DA of the display panel DP in parallel with data lines DL(1) through DL(4M). For example, the feedback lines FLB1-FBL4 are located between an edge of the display area and the first data line DL(1). In an embodiment, the plurality of feedback lines FBL0, FBL1, FBL2, FBL3 and FBL4 are connected to one data line DL(1) of the data lines DL(1) through DL(4M) closest to the plurality of gate drivers GIC1, GIC2, GIC3 and GIC4. Accordingly, since the plurality of feedback lines FBL0, FBL1, FBL2, FBL3 and FBL4 are connected to the outermost data line DL(1), an aperture ratio of the display panel DP is not substantially reduced.

Figure 11:
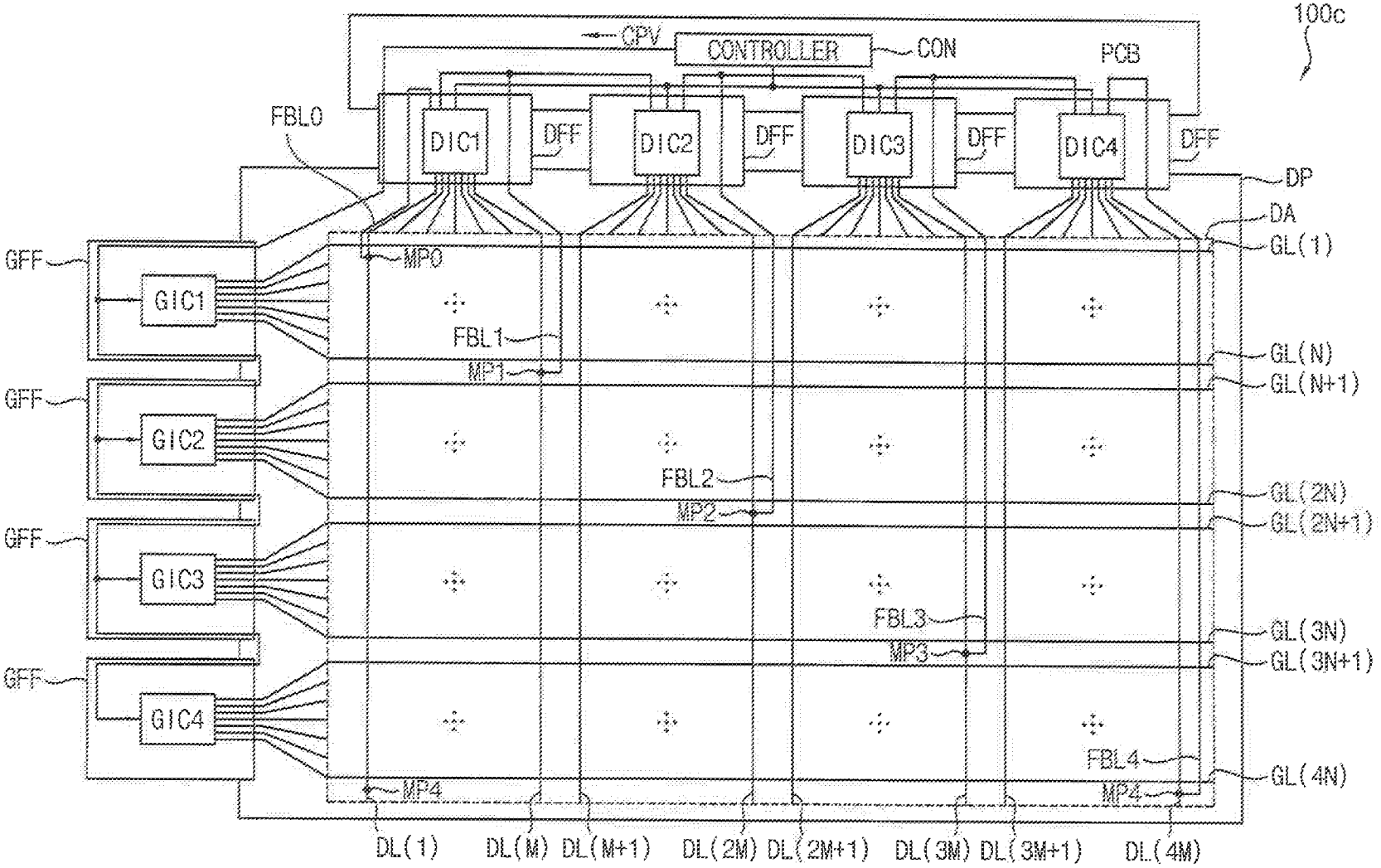
FIG. 11 is a diagram illustrating a display device according to an exemplary embodiment of the inventive concept.

FIG. 11 is a diagram illustrating a display device according to an exemplary embodiment of the inventive concept.

Referring to FIG. 11, a display device 100*c* includes a display panel DP having a plurality of pixels within a display area DA, a plurality of data drivers DIC1, DIC2, DIC3 and DIC4 providing data voltages to the plurality of pixels, a plurality of gate drivers GIC1, GIC2, GIC3 and GIC4 providing gate signals to the plurality of pixels, a controller CON controlling the plurality of data drivers DIC1, DIC2, DIC3 and DIC4 and the plurality of gate drivers GIC1, GIC2, GIC3 and GIC4, and a plurality of feedback lines FBL0, FBL1, FBL2, FBL3 and FBL4 respectively connected to a plurality of data lines DL(1), DL(M), DL(2M), DL(3M) and DL(4M). The display device 100*c* of FIG. 11 may have substantially the same configuration and operation as a display device 100 of FIG. 1, except for arrangements of the plurality of feedback lines FBL0, FBL1, FBL2, FBL3 and FBL4 and data voltage delay amount measurements by the plurality of data drivers DIC1, DIC2, DIC3 and DIC4.

In an exemplary embodiment, the plurality of feedback lines FBL1, FBL2, FBL3 and FBL4 are formed within a display area DA of the display panel DP in parallel with data lines DL(1) through DL(4M). Further, as illustrated in FIG. 11, the plurality of feedback lines FBL0, FBL1, FBL2, FBL3 and FBL4 are connected to different data lines DL(1), DL(M), DL(2M), DL(3M) and DL(4M) such that a plurality of measurement positions MP0, MP1, MP2, MP3 and MP4 (e.g., points or nodes) are disposed in a diagonal direction within the display area DA. For example, as illustrated in FIG. 11, a start gate feedback line FBL0 is connected to a first data line DL(1), a first last gate feedback line FBL1 is connected to an M-th data line DL(M), a second last gate feedback line FBL2 is connected to a 2M-th data line DL(2M), a third last gate feedback line FBL3 is connected to a 3M-th data line DL(3M), and a fourth last gate feedback line FBL4 is connected to a 4M-th data line DL(4M).

Further, in an exemplary embodiment, each of the data drivers DIC1, DIC2, DIC3 and DIC4 receives two feedback voltages through a feedback line connected to a last data line of a previous data driver and a feedback line connected to a last data line of the each data driver, and measures a delay amount between the two feedback voltages. For example, a first data driver DIC1 receives two feedback voltages through the start gate feedback line FBL0 connected to the first data line DL(1) and the first last gate feedback line FBL1 connected to the last data line DL(M), and measures a delay amount between the two feedback voltages received through the start gate feedback line FBL0 and the first last gate feedback line FBL1. A second data driver DIC2 receives two feedback voltages through the first last gate feedback line FBL1 connected to the last data line DL(M) of the first data driver DIC1 and the second last gate feedback line FBL2 connected to the last data line DL(2M) of the second data driver DIC2, and measures a delay amount between the two feedback voltages received through the first last gate feedback line FBL1 and the second last gate feedback line FBL2. A third data driver DIC3 receives two feedback voltages through the second last gate feedback line FBL2 connected to the last data line DL(2M) of the second data driver DIC2 and the third last gate feedback line FBL3 connected to the last data line DL(3M) of the third data driver DIC3, and measures a delay amount between the two feedback voltages received through the second last gate feedback line FBL2 and the third last gate feedback line FBL3. A fourth data driver DIC4 receives two feedback voltages through the third last gate feedback line FBL3 connected to the last data line DL(3M) of the third data driver DIC3 and the fourth last gate feedback line FBL4 connected to the last data line DL(4M) of the fourth data driver DIC4, and measures a delay amount between the two feedback voltages received through the third last gate feedback line FBL3 and the fourth last gate feedback line FBL4. In this case, each of the data drivers DIC1, DIC2, DIC3 and DIC4 may include a data voltage delay measurer to measure the data voltage delay amount. Each of the data drivers DIC1, DIC2, DIC3 and DIC4 may provide information about the measured data voltage delay amount, or information about a gate shift amount to the controller CON, and the controller CON may shift a gate clock signal CPV based on the information about the gate shift amount received from the plurality of data drivers DIC1, DIC2, DIC3 and DIC4.

Figure 12:
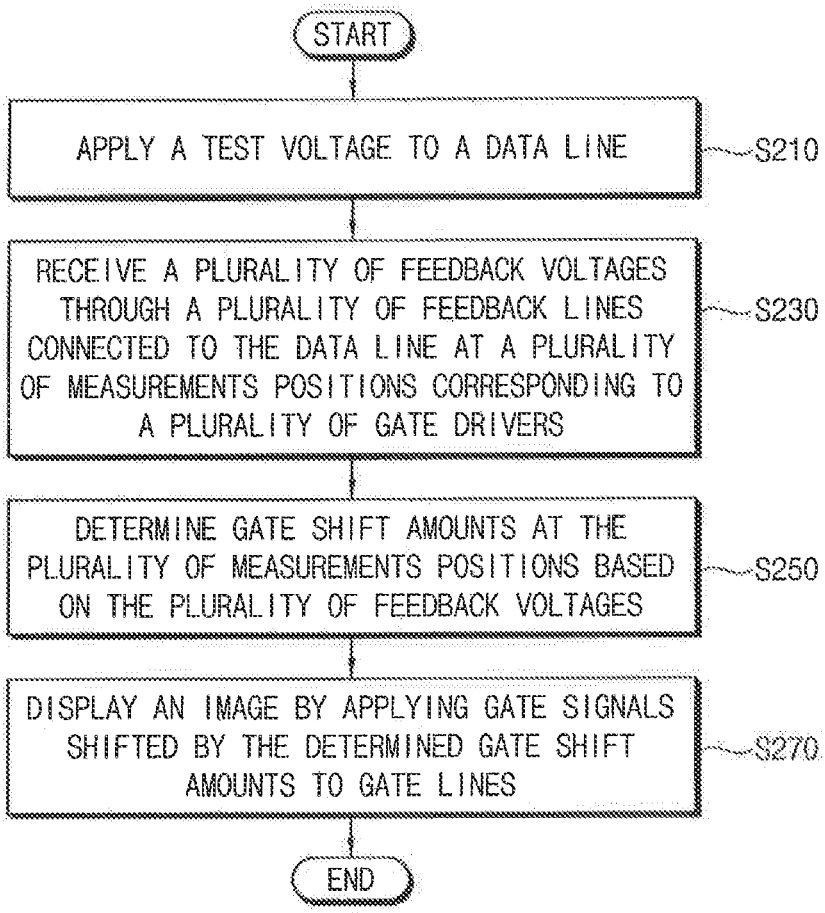
FIG. 12 is a flowchart illustrating a method of operating a display device according to an exemplary embodiment of the inventive concept.

FIG. 12 is a flowchart illustrating a method of operating a display device according to an exemplary embodiment of the inventive concept.

Referring to FIG. 12, in a method of operating a display device including a plurality of gate drivers, at least one data driver included in the display device applies a test voltage to a data line (S210).

The data driver receives a plurality of feedback voltages through a plurality of feedback lines connected to the data line at a plurality of measurement positions corresponding to the plurality of gate drivers (S230). In an exemplary embodiment, the data driver receives one of the feedback voltages through a start gate feedback line connected to the data line at the measurement position corresponding to a gate line closest to the data driver, and receives the remaining feedback voltages through a plurality of last gate feedback lines each of which connected to the data line at the measurement position corresponding to a last gate line of a corresponding gate driver. In an exemplary embodiment, as illustrated in FIGS. 1 and 8, at least a portion of each feedback line is located on a plurality of flexible films on which the plurality of gate drivers are mounted. In an exemplary embodiment, as illustrated in FIGS. 10 and 11, the plurality of feedback lines are located within a display area of a display panel.

The data driver determines gate shift amounts at the plurality of measurement positions corresponding to the plurality of gate drivers based on the plurality of feedback voltages (S250). In an exemplary embodiment, the data driver measures delay amounts of the plurality of feedback voltages received through the plurality of last gate feedback lines with respect to the feedback voltage received through the start gate feedback line, and determines the gate shift amounts at the plurality of measurement positions as the delay amounts of the plurality of feedback voltages.

The display device displays an image by applying gate signals that are shifted by the determined gate shift amounts to gate lines (S270). For example, the data driver may provide a controller with information about the determined gate shift amounts, the controller may shift a gate clock signal CPV based on the information about the determined gate shift amounts, and the plurality of gate drivers may apply gate signals that are shifted by the determined gate shift amounts to the gate lines in response to the shifted gate clock signal. Accordingly, a reduction of a charging rate of a pixel and a deterioration of an image quality according to a distance from the data driver may be prevented.

Figure 13:
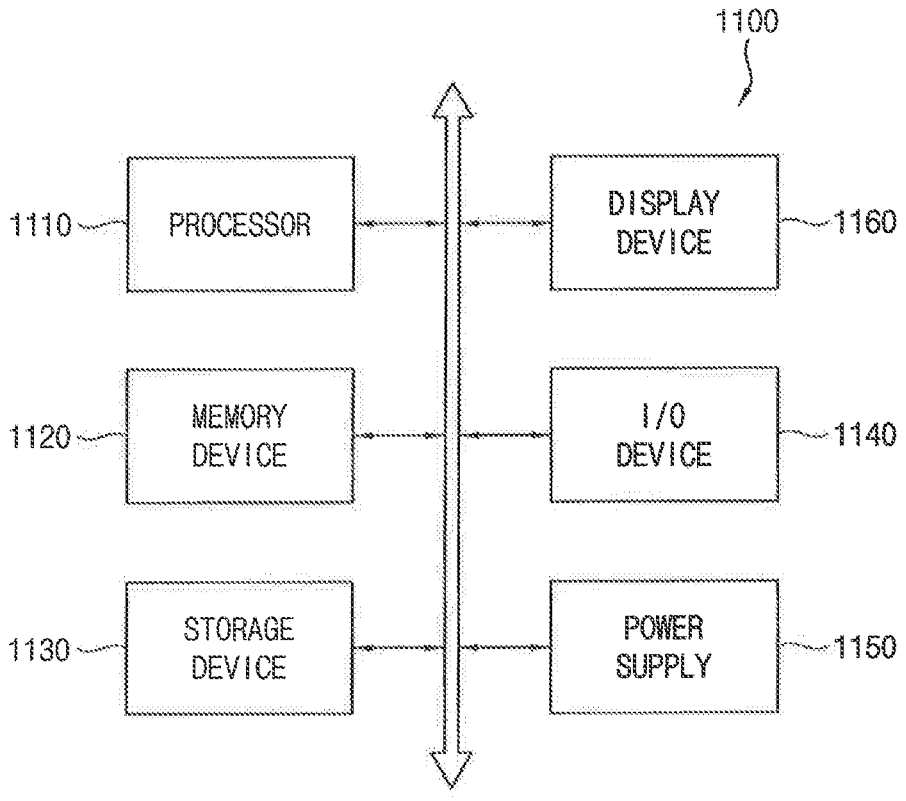
FIG. 13 is a block diagram illustrating an example of an electronic device including a display device according to an exemplary embodiment of the inventive concept.

FIG. 13 is a block diagram illustrating an example of an electronic device including a display device according to an exemplary embodiment of the inventive concept.

Referring to FIG. 13, an electronic device 1100 includes a processor 1110, a memory device 1120, a storage device 1130, an input/output (I/O) device 1140, a power supply 1150, and a display device 1160. The electronic device 1100 may further include a plurality of ports for communicating with a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in an exemplary embodiment, the processor 1110 is further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100.

The display device 1160 may be implemented by any one of display devices 100, 100*a*, 100*b*, or 100*c*. The display device 1160 may include at least one feedback line per each gate driver to measure data voltage delay amounts for respective gate drivers, and thus may automatically and accurately set gate shift amounts for the respective gate drivers. Accordingly, the display device 1160 may prevent a reduction in a charging rate of a pixel and a deterioration of an image quality according to a distance of the pixel from a data driver.

According to an exemplary embodiments, the electronic device 1100 may be any electronic device including the display device 1160, such as a digital television, a 3D television, a personal computer (PC), a home appliance, a laptop computer, a cellular phone, a smart phone, a tablet computer, a wearable device, a personal digital assistant (PDA), a portable multimedia player (PMP), a digital camera, a music player, a portable game console, a navigation system, etc.

Although a few exemplary embodiments have been described above, those skilled in the art will readily appreciate that many modifications are possible in the exemplary embodiments without materially departing from the present inventive concept. Accordingly, all such modifications are intended to be included within the scope of the present inventive concept.

What is claimed is:

1. A display device comprising:

a display panel including a plurality of data lines, a plurality of gate lines, and a plurality of pixels connected to the data lines and the gate lines;

at least one data driver configured to drive the data lines;

a plurality of gate drivers, each of the plurality of gate drivers configured to drive a corresponding portion of the gate lines; and a plurality of feedback lines connected to at least one of the data lines at a plurality of measurement positions corresponding to the plurality of gate drivers, wherein each feedback line feeds a feedback voltage of a corresponding one of the measurement positions back to the at least one data driver, wherein the data driver applies a test voltage to the at least one of the data lines, receives the test voltage as a plurality of feedback voltages through the plurality of feedback lines, and determines gate shift amounts at the plurality of measurement positions corresponding to the plurality of gate drivers based on the plurality of feedback voltages, and wherein the gate drivers apply gate signals to the gate lines that are shifted by the determined gate shift amounts.

2. The display device of claim 1, wherein the plurality of feedback lines comprises:

a plurality of last gate feedback lines, wherein each of the plurality of last gate feedback lines is connected to the at least one of the data lines at the measurement position corresponding to a last gate line among the corresponding portion of the gate lines driven by a corresponding one of the plurality of gate drivers.

3. The display device of claim 2, wherein the plurality of feedback lines further comprises:

a start gate feedback line connected to the at least one of the data lines at the measurement position corresponding to one of the gate lines closest to the data driver.

4. The display device of claim 3, wherein the data driver measures delay amounts of the plurality of feedback voltages received through the plurality of last gate feedback lines with respect to the feedback voltage received through the start gate feedback line, and determines the gate shift amounts at the plurality of measurement positions as the delay amounts of the plurality of feedback voltages.

5. The display device of claim 4, wherein the data driver comprises:

a plurality of comparators configured to compare the plurality of feedback voltages received through the plurality of last gate feedback lines and the start gate feedback line with a reference voltage;

a plurality of XOR gates, each of the plurality of XOR gates configured to perform an XOR operation on two adjacent output signals among a plurality of output signals output by the plurality of comparators; and a plurality of counters configured to count high periods of a plurality of output signals output by the plurality of XOR gates.

6. The display device of claim 3, wherein the plurality of feedback lines further comprises:

a plurality of middle gate feedback lines, each of the plurality of middle gate feedback lines connected to the at least one of the data lines at the measurement position corresponding to a middle gate line among the corresponding portion of the gate lines driven by the corresponding one of the plurality of gate drivers.

7. The display device of claim 1, wherein the plurality of gate drivers are mounted on a plurality of flexible films attached to the display panel, and wherein a portion of each of the plurality of feedback lines is located on the plurality of flexible films.

8. The display device of claim 7, wherein the portion of each of the plurality of feedback lines is located on an outer portion of each flexible film outside a mounting region of the flexible film where each gate driver is mounted.

9. The display device of claim 7, wherein the plurality of feedback lines are connected to one of the data lines closest to the plurality of gate drivers.

10. The display device of claim 1, wherein the plurality of feedback lines are located within a display area of the display panel and in parallel with the data lines.

11. The display device of claim 10, wherein the plurality of feedback lines are connected to one of the data lines closest to the plurality of gate drivers.

12. The display device of claim 10, wherein the at least one data driver includes a plurality of data drivers, and wherein the plurality of feedback lines are connected to different ones of the data lines such that the plurality of measurement positions are disposed in a diagonal direction within the display area.

13. The display device of claim 12, wherein a current one of the plurality of data drivers receives two feedback voltages of the plurality of feedback voltages through a first one of the plurality of feedback lines connected to a last data line of a previous one of the plurality of data drivers and a second one of the plurality of feedback lines connected to a last data line of the current one data driver, and measures a delay amount between the two feedback voltages.

14. The display device of claim 1, further comprising:

a controller configured to control the data driver and the plurality of gate drivers, wherein the data driver provides the controller with information about the determined gate shift amounts at the plurality of measurement positions corresponding to the plurality of gate drivers, and wherein the controller shifts a gate clock signal provided to the plurality of gate drivers such that the plurality of gate drivers apply the gate signals to the gate lines that are shifted by the determined gate shift amounts.

15. The display device of claim 14, wherein the controller calculates gate shift amounts for the gate lines between the gate lines corresponding to the plurality of measurement positions by linearly interpolating the determined gate shift amounts at the plurality of measurement positions.

16. A method of operating a display device including a plurality of gate drivers, the method comprising:

applying a test voltage to a data line of the display device;

feeding a plurality of feedback voltages from a plurality of measurement positions corresponding to the plurality of gate drivers back to at least one data driver of the display device through a plurality of feedback lines connected at the measurement positions to the data line;

determining gate shift amounts at the plurality of measurement positions corresponding to the plurality of gate drivers based on the plurality of feedback voltages; and displaying an image by applying gate signals to gate lines of the display device that are shifted by the determined gate shift amounts.

17. A display device comprising:

a display panel including a plurality of data lines, a plurality of gate lines, and a plurality of pixels connected to the data lines and the gate lines;

a data driver configured to drive the data lines;

a gate driver configured to drive the gate lines;

a first feedback line connected to the first data driver and a first node on a first data line among the data lines nearest the gate driver at a first position of a first gate line among the gate lines nearest the data driver; and a second feedback line connected to the data driver and a second node on the first data line at a second position of a last gate line among the gate lines farthest from the data driver;

wherein the data driver applies a test voltage to the first data line, samples the first feedback line to read a first feedback voltage, samples the second feedback line to read a second feedback voltage, and determines gate shift amounts from the read first and second feedback voltages, and wherein the gate driver applies gate signals to the gate lines that are shifted by the determined gate shift amounts.

18. The display device of claim 17, wherein the data driver comprises:

a first comparator configured to receive a reference voltage and the first feedback voltage;

a second comparator configured to receive the reference voltage and the second feedback voltage; XOR gate configured to receive an output from each of the comparators; and a counter configured to count an output of the XOR gate, wherein the data driver determines the gate shift amounts from an output of the counter.

19. The display device of claim 17, wherein a portion of the second feedback line is wrapped around the gate driver.

20. The display device of claim 17, a portion of the feedback lines are arranged in an area between an edge of a display area of the display panel and the first data line.

* * * * *